United States Patent [19]

Holmes et al.

[11] Patent Number: 4,465,726

[45] Date of Patent: Aug. 14, 1984

[54] RIBBED TERRY CLOTH-LIKE NONWOVEN FABRIC AND PROCESS AND APPARATUS FOR MAKING SAME

[75] Inventors: Rory A. Holmes, Princeton; Donald V. Skistimas, Milltown, both of N.J.

[73] Assignee: Chicopee, New Brunswick, N.J.

[21] Appl. No.: 507,414

[22] Filed: Jun. 23, 1983

[51] Int. Cl.[3] ..... B32B 3/10

[52] U.S. Cl. ..... 428/131; 28/105; 28/106; 428/224

[58] Field of Search ..... 428/131, 224; 28/105, 28/106

[56] References Cited

U.S. PATENT DOCUMENTS

| | | | |
|---|---|---|---|
| 2,862,251 | 12/1958 | Kalwaites | 19/161 |
| 3,033,721 | 5/1962 | Kalwaites | 154/46 |
| 3,081,500 | 3/1963 | Griswold et al. | 19/161 |
| 3,485,706 | 1/1969 | Evans | 161/72 |
| 3,493,462 | 2/1970 | Bunting, Jr. et al. | 161/169 |
| 3,498,874 | 3/1970 | Evans et al. | 161/109 |
| 4,144,370 | 3/1979 | Boulton | 428/233 |
| 4,379,799 | 4/1983 | Holmes et al. | 428/131 |

*Primary Examiner*—Marion McCamish
*Attorney, Agent, or Firm*—Leonard Kean

[57] ABSTRACT

Ribbed terry cloth-like nonwoven fabric produced by fluid entangling of fibers on a special forming belt.

14 Claims, 10 Drawing Figures

AND REPEAT EVERY 8 WARPS

RIBBED TERRY CLOTH-LIKE NONWOVEN FABRIC AND PROCESS AND APPARATUS FOR MAKING SAME

This invention relates to a ribbed terry cloth-like non-woven fabric and to a process and apparatus for producing it.

BACKGROUND OF THE INVENTION

Methods for preparing nonwoven fabrics by means of fluid rearrangement and entangling of fibers are well known. See for instance Kalwaites' U.S. Pat. Nos. 2,862,251 and 3,033,721; Griswold et al. U.S. Pat. No. 3,081,500; Evans U.S. Pat. No. 3,485,706; Bunting et al. U.S. Pat. No. 3,493,462 and Boulton U.S. Pat. No. 4,144,370. This basic technology has been used to produce a wide variety of nonwoven fabrics. The present invention utilizes fluid rearrangement and entanglement to provide a ribbed terry cloth-like nonwoven fabric by carrying out the fluid rearrangements/entanglement on a particular type of carrier belt.

SUMMARY OF THE INVENTION

In accordance with the present invention there is provided a nonwoven fabric having the appearance of apertured ribbed terry cloth, said fabric being characterized by a repeating pattern of spaced, parallel ribs, said ribs comprising areas of nodule-like tangled fibers alternating with parallelized strands of fibers running substantially in the direction of the longitudinal axes of the ribs, said nodules being interconnected to the nodules in neighboring ribs through a network of bundles of fibers, each of which bundles is substantially entangled, said bundles defining rows of apertures running parallel to the ribs. The core of each nodule comprises fibers oriented substantially perpendicular to the longitudinal axis of each rib, the surface fibers of the nodules being highly randomized in direction.

The fabric of the invention is preferably made of rayon fibers and weighs from about 1 to about 4 ounces per square yard. The fabric of the invention is prepared on a forming means comprising a woven belt having a cross section through eight successive warps as shown in FIG. 10 herein. The detailed structure of the belt is discussed hereinafter.

The fabric of the invention is produced by a process which comprises:

(a) Supporting a layer of fibrous starting material whose individual fibers are in mechanical engagement with one another but which are capable of movement under applied liquid forces, on a liquid pervious support member, adapted to move in a predetermined direction and on which fiber movement in directions both in and at an angle to the plane of said layer is permitted in response to applied liquid forces, said support member comprising a woven belt having a cross section through eight successive warps as shown in FIG. 10 herein;

(b) moving the supported layer in said predetermined direction through a fiber rearranging zone within which streams of high pressure, fine, essentially columnar jets of liquid are projected directly onto said layer; and (c) passing said streams of liquid through said layer and said support member in said fiber rearranging zone to effect movement of fibers such that the nonwoven fabric, defined above, is formed.

The apparatus for producing the fabric of the invention comprises:

(a) liquid pervious forming means for supporting a layer of fibrous starting material whose individual fibers are capable of movement under applied liquid forces;

(b) means for projecting streams of high pressure, fine, essentially columnar jets of liquid; and (c) means for passing said layer of fibrous starting material directly under said streams while said layer is supported on said liquid pervious forming means, said liquid pervious forming means comprising a woven belt having a cross section through eight consecutive warps as shown in FIG. 10 herein.

The apparatus of the present invention preferably includes vacuum means beneath the liquid pervious forming means, said vacuum means being positioned directly under said means for projecting streams of high pressure, fine, essentially columnar jets of liquid.

The woven belt which is preferably used in accordance with the present invention contains 84 warps per inch and 32 picks per inch. Preferably, both the warps and the picks of the woven belt are about 0.157 inch in diameter.

THE PRIOR ART

In Evans et al. U.S. Pat. No. 3,498,874, there is disclosed entangled nonwoven fabric produced by fluid rearrangements/entanglement on a woven carrier belt having heavier wires in one direction and 3 to 5 times as many finer wires in the other direction. Although FIG. 23 of said U.S. Pat. No. 3,498,874 shows a fabric structure having certain similarities to the fabric of the present invention, nevertheless there is no disclosure of clearly defined parallel raised ribs which comprise areas of nodule-like tangled fibers alternating with parallelized strands of fibers running in the direction of the longitudinal axis of the rib.

U.S. Pat. No. 3,485,706, also issued to Evans, discloses in FIG. 32, a fabric having certain similarities to the fabric of the present invention. However, the structure of the ribs and interconnecting bundles of the present invention clearly distinguishes over the Evans fabrics.

U.S. Pat. No. 4,379,799 relates to a nonwoven fabric having the appearance of apertured ribbed terry cloth, but the structure of the ribs thereof is quite different from the structure of the ribs of the present fabric.

Copending U.S. patent application Ser. No. 341,924, filed Jan. 22, 1982 discloses fabrics somewhat similar to those of the present invention but the reference fabric is constructed in such a way that a small amount of adhesive binder is required to resist wet collapse of the web. No adhesive binder is required in connection with the present fabric.

DETAILED DESCRIPTION OF THE INVENTION

Figure 1:
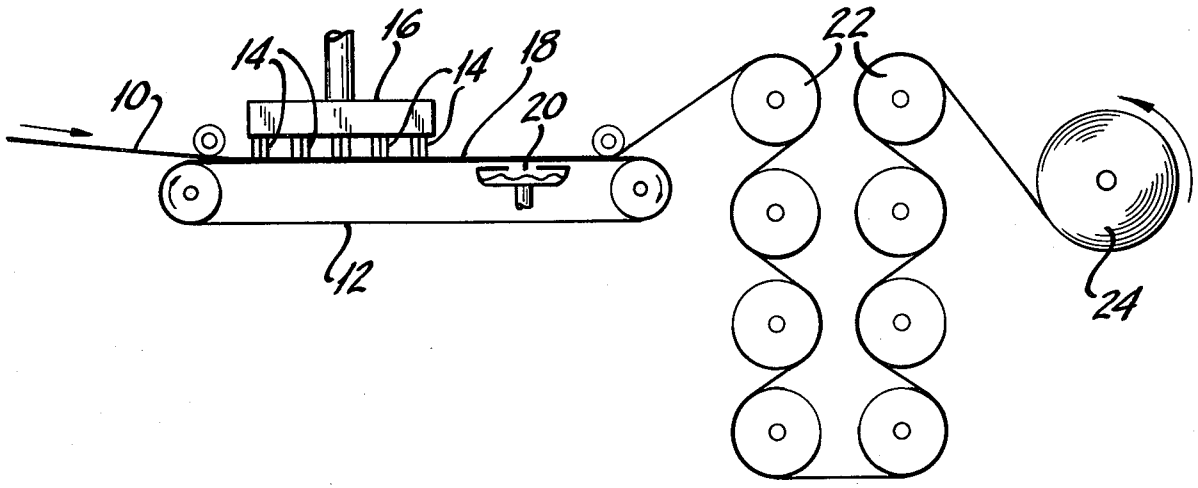
FIG. 1 is a schematic side elevation of an arrangement of an apparatus that can be used to carry out the process of the invention.

The nonwoven fabric of this invention is produced by the fluid rearrangement/entanglement of a web comprising a loose array of fibers, on a liquid pervious forming belt of special construction which is described fully below. For instance, referring first to FIG. 1, a carded or random laid web 10 of staple fibers can be passed onto an endless belt 12 which constitutes the woven forming belt. The belt 12 carries the web of fibers 10 under a series of high pressure, fine, essentially columnar jets of water 14. The high pressure water is supplied from the manifold 16. The jets 14 are arranged in rows disposed transversely across the path of travel of the forming belt 12. Preferably there is a vacuum slot (not shown) pulling a vacuum of e.g. 1 to 15 inches of mercury, beneath the forming belt 12, directly under each row of jets 14, in order to optimize durability of the fabric product. The fibers in the web 10 are rearranged and entangled by the jets 14 as the liquid from the jets 14 passes through the fibrous web 10 and then through the belt 12 to form the fabric 18 of the invention. The fabric 18 is carried by the belt 12 over a vacuum dewatering station 20 and then proceeds to a series of drying cans 22 and from there to a windup 24.

Evans in U.S. Pat. No. 3,485,706, describes a process and apparatus for rearranging/entangling fibrous webs by carrying such webs on a woven belt on a series of high pressure, fine, columnar jets of water. The disclosure of Evans is incorporated herein by reference.

The invention can use a wide variety of staple fibers, including rayon, polyester, nylon, polypropylene, bicomponent fibers, cotton and the like, including mixtures thereof. Staple fibers are used, that is fibers having lengths of up to about 3 inches. The belt speeds, water jet pressure and the number of rows of jets have not been found to be narrowly critical. Representative conditions are as follows:

Belt speed: about 30 to 300 feet/minute
Jet pressure: about 500 to 2000 psi
Rows of jets: about 12 to 100

Carded or random laid webs can be used. Typical web weights are from about 1½ to about 6 ounces per square yard.

As a general rule the heavier webs use slower belt speed and/or higher jet pressure and/or more rows of jets. Also in order to achieve maximum durability of the heavier fabrics (e.g., fabrics weighing about 3 ounces or more per square yard), sequential entangling is often desirable. "Sequential entangling" refers to the practice of first rearranging/entangling a web having a basis weight of a fraction (e.g., about ½) of that of the final product, and without removing the rearranged/entangled web from the forming belt, adding another web of fibers on top of the first and subjecting the combined layers to the rearranging/entangling step.

Figure 10:
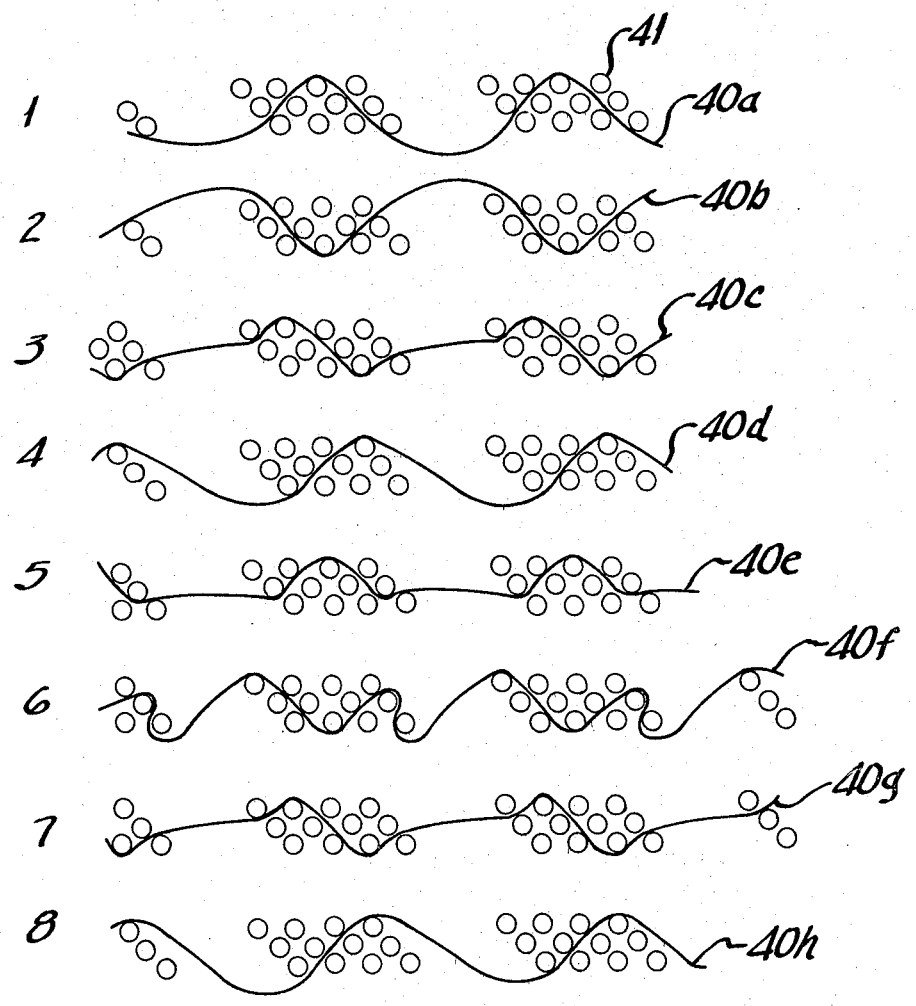
FIG. 10 is a schematic cross section through eight successive warps of the forming belt used in Example 1.

The principle novelty in the process and apparatus of the present invention resides in the use of the special forming belt. An illustration of such a belt is shown in FIG. 10. The belt is woven from fine warp monofilaments (preferably of 0.0157 inch diameter) which extend in the direction of travel of the belt, and fine pick monofilaments which are preferably of the same diameter as those of the warp monofilaments. The belt is woven in such a manner that the topography of the top surface of the belt (that is the surface which the fibers will contact) has lower parallel valleys alternating with flat highlands. The lowered valleys are formed by the intricate weave of the warp monofilaments 40. The weave of the forming belt is such that groups of twelve pick monofilaments 41 are separated by depressions in the top surface. In FIG. 10, it will be noted, that the circles 41 are picks and the lines **40*a* through 40*h* are warps, the pattern being repeated every eight warps. The belt has considerable thickness which is obtained by weaving in repeating groups of twelve picks 41 which, in the final belt product, are pressed slightly out of normal position due to the tension or force enparted by the warps 40. The manner in which the successive warps 40*a* through 40*h* are woven between groups of twelve picks is clearly illustrated in FIG. 10**. The preferred belt used in accordance with the present invention contains 84 warps per inch and 32 picks per inch, all of which are made of polyester and are 0.0157 inch in diameter.

The invention will be further illustrated in greater detail by the following examples. It should be understood, however, that although the examples may describe in particular detail some of the more specific features of the present invention, they are given primarily for purposes of illustration and the invention in its broader aspect is not to be construed as limited thereto.

EXAMPLE 1

Figure 6:
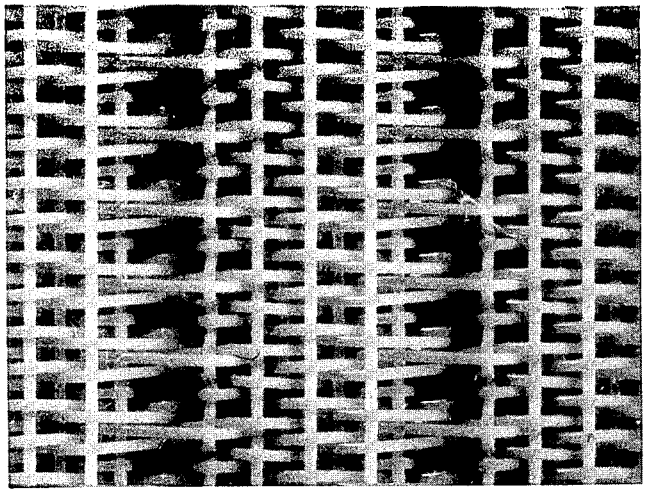
FIGS. 6 and 7 are photomacrographs of the top and bottom sides respectively of the forming or carrier belt used in producing the fabric of Example 1 (magnification 5×).
Figure 7:
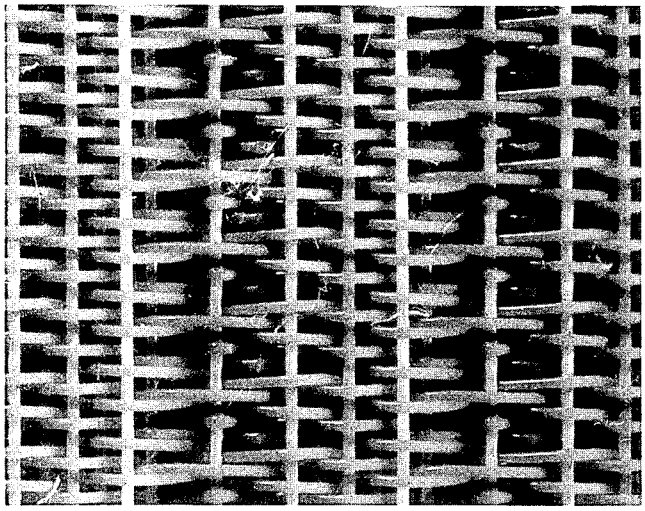
Figure 8:
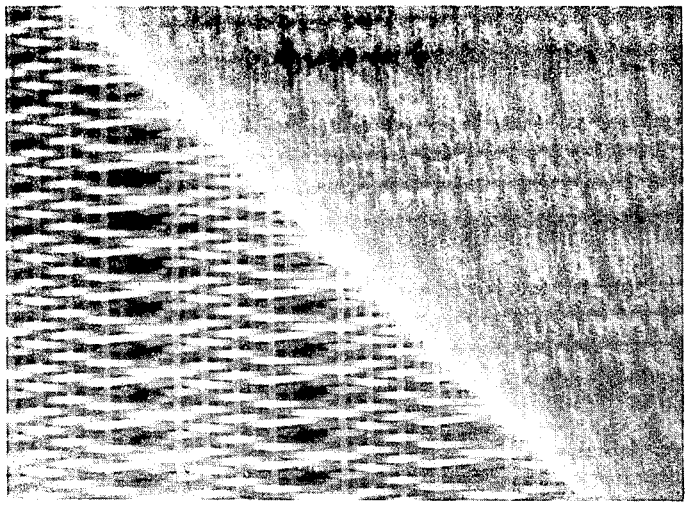
FIG. 8 is a photomacrograph (magnification 3×) of the forming or carrier belt used in Example 1, with a portion of the fabric formed thereon also shown.

Avtex SN 1913 1.5 denier, 1⅛ inch staple rayon was processed through an opener blender and fed through a random air layering unit which deposited a 2-ounce per square yard web of random formed fibers on the forming belt. The forming belt (FIGS. 6–8) contained 84 warps per inch and 32 picks per inch, all of which were made of polyester and were of 0.0157 inch in diameter. The web was passed under a water weir to wet the fiber and then processed under 15 orifice strips. The orifice strips contained a row of holes, 50 holes per inch, of 0.005 inch diameter, through which the water jetted. Under the manifold the web is exposed to water jets operating at the following pressures:

First three strips 100 psig
Second three strips 300 psig
Next nine strips 1000 psig Under the forming belt directly under the row of holes in each orifice strip there was located a series of vacuum slots. Each slot was ¼ inch wide and pulled a vacuum of about 13 to 14 inches of mercury. The entangled web was dewatered and another 2 ounce web of the same rayon was added on top. The entangled web was not removed from the forming belt but stayed in registry with it. The combined webs were processed under the same conditions as defined above.

The entire process was operated at 10 yards per minute.

The completed entangled fabric was dried over 2 stacks of steam cans operating at 60 pounds and 80 pounds of steam, respectively, and was then rolled up.

EXAMPLE.2

Three samples were made using the rayon fiber described in Example 1. The equipment described in Example 1 was used except that only 12 strips were used. The strip pressures were the following:
First three strips 100 psig
Second three strips 400 psig
Next six strips 1200 psig The line speed was 10 yards per minute. Steam cans were operated at 325° F. The three fabrics differed in grain weight as follows:
A 450 grains per square yard
B 900 grains per square yard
C 1700 grains per square yard Samples A and B were processed as a single layer of fiber and removed from the forming belt. Sample C was produced by sequential entangling of two 850 grain webs as described in Example 1. With samples A and B the vacuum pull on the slots beneath the rows of jets was about 7 to 8 inches of mercury. In sample C, the vacuum was about 13 to 14 inches of mercury.

Figure 2:
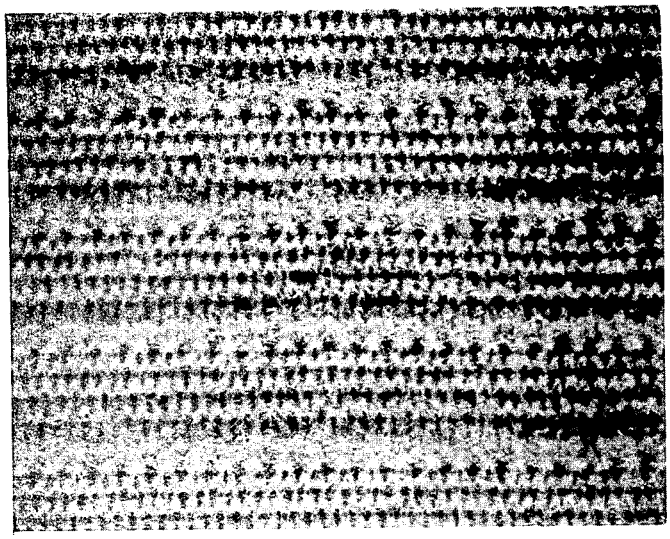
FIG. 2 is a photograph of the fabric of Example 1, the original photograph showing the fabric at 2× magnification.
Figure 3:
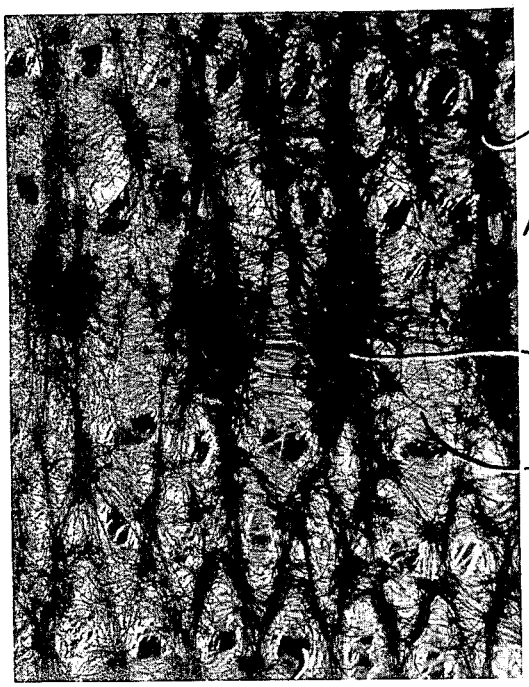
FIG. 3 is a photomacrograph of the fabric of FIG. 2, originally taken at a magnification of 10×.

The fabric prepared in accordance with Example 1 is shown in FIGS. 2 through 5 and 8. FIG. 2, which shows the fabric of the invention at a 2× magnification shows the apertures which are defined between the bundles. However, there is insufficient magnification in FIG. 2 in order to observe the ribs clearly. The repeating pattern of spaced parallel ribs 31 are clearly evident in FIG. 3. It will be noted that said ribs comprise alternating nodules 32 and parallelized fibers 33. It will be further noted that the nodules 32 are interconnected by a network of bundles of fibers 34 which extend obliquely from the nodules 32 and form, together with the ribs 31 a net-like structure. It will also be noted that apertures 35 are defined between the bundles 34. Each interconnecting bundle 34 is substantially wholly entangled. The apertures 35 are substantially congruent, that is they are all about the same size and shape when viewed with the naked eye.

Figure 4:
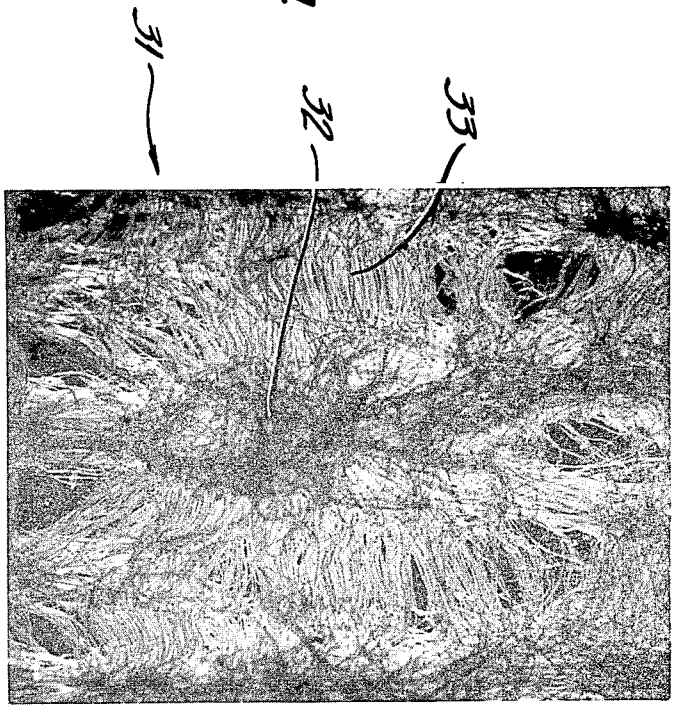
FIG. 4 is a photomacrograph of the fabric of FIG. 2, illuminated from below and at a magnification of 20×.
Figure 5:
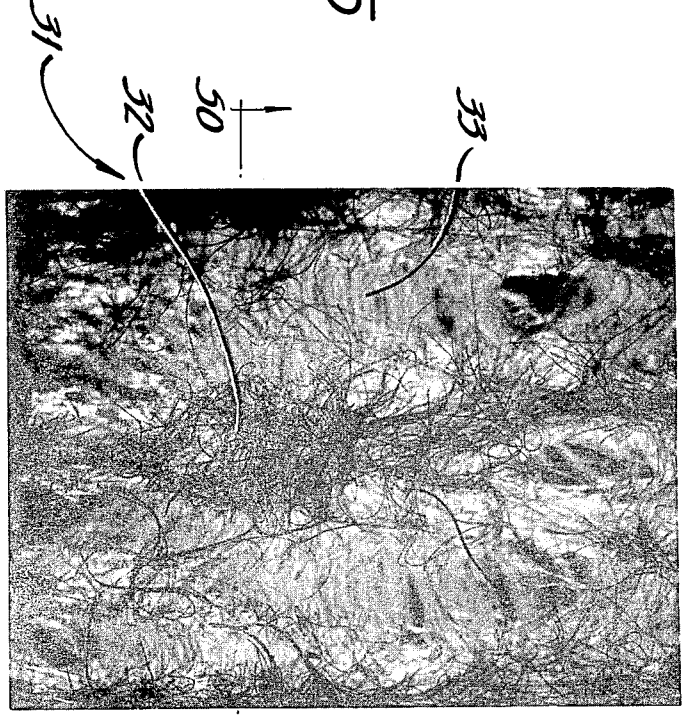
FIG. 5 is a photomacrograph of the fabric of FIG. 2, illuminated from above, at a magnification of 20×.

FIGS. 4 and 5 are 20× magnifications of a denser portion of rib 31 and clearly illustrate the nodules 32 and parallelized fibers 33. In FIG. 4 the camera is focused on the bottom of the fabric, whereas, in FIG. 5, the camera is focused on the top of the fabric.

Figure 9:
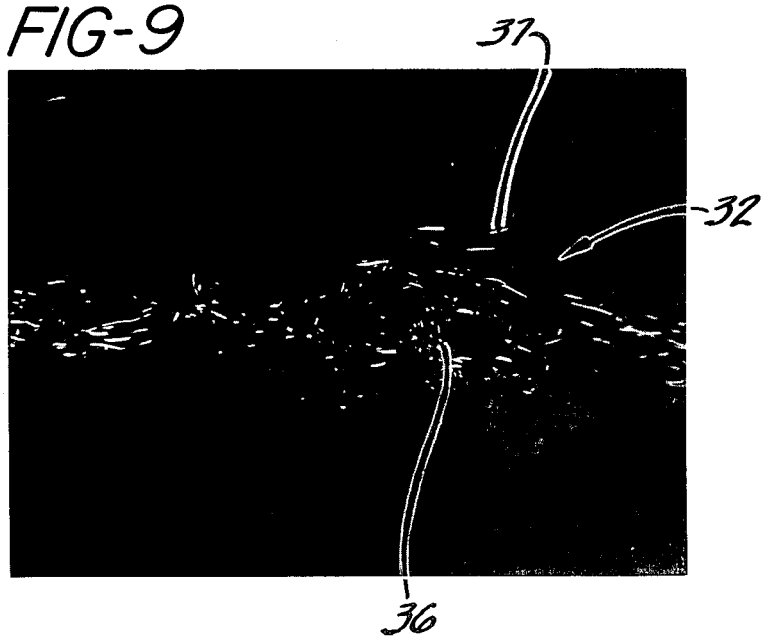
FIG. 9 is a photomacrograph (magnification 35×, using polarized light) of a cross sectional view taken along line 50—50 of FIG. 5.

If a cross section of one of the nodules 32 is examined under high magnification (as shown in FIG. 9), it is clearly evident that the core of each nodule comprises fibers 36 oriented substantially perpendicular to the longitudinal axis of each rib. It will also be observed that the surface fibers 37 of the nodule 32 are highly randomized in direction. In FIG. 9, the dots or specks are fibers cut at right angles to the long axis of each fiber. If a fiber is at an angle to the cut, it appears as an elongated white slash.

We claim:

1. A nonwoven fabric having the appearance of apertured ribbed terry cloth, said fabric being characterized by a repeating pattern of spaced parallel ribs, said ribs comprising areas of nodule-like tangled fibers alternating with parallelized strands of fibers running substantially in the direction of the longitudinal axes of the ribs, said nodules being interconnected to the nodules in neighboring ribs through a network of bundles of fibers each of which bundles is substantially entangled, said bundles defining rows of apertures running parallel to the ribs.

2. The fabric of claim 1 wherein the core of each nodule comprises fibers oriented substantially perpendicular to the longitudinal axis of each rib, the surface fibers of the nodules being highly randomized in direction.

3. The fabric of claim 1, having been prepared on a forming means comprising a woven belt having a cross section through eight successive warps as shown in FIG. 9 herein.

4. The fabric of claim 3, wherein the fabric weighs from about 1 to about 4 ounces per square yard.

5. The fabric of claim 3 wherein said fabric is made of rayon fibers.

6. The fabric of claim 3, wherein the fabric is made of blends of rayon and polyester fibers.

7. A process for producing the fabric of claim 1, which comprises:

(a) supporting a layer of fibrous starting material whose individual fibers are in mechanical engagement with one another but which are capable of movement under applied liquid forces, on a liquid pervious support member adapted to move in a predetermined direction and on which fiber movement in directions both in and at an angle to the plane of said layer is permitted in response to applied liquid forces, said support member comprising a woven belt having a cross section through eight successive warps as shown in FIG. 10 herein;

(b) moving the supported layer in said predetermined direction through a fiber rearranging zone within which streams of high pressure, fine, essentially columnar jets of liquid are projected directly onto said layer; and (c) passing said streams of liquid through said layer and said support member in said fiber rearranging zone to effect movement of fibers such that the nonwoven fabric of claim 1 is formed.

8. The process of claim 7 wherein said layer of fibrous starting material comprises rayon fibers.

9. The process of claim 7 wherein the nonwoven fabric product of said process weighs from about 1 to about 4 ounces per square yard.

10. The process of claim 7 wherein said layer of fibrous starting material comprises blends of rayon and polyester fibers.

11. Apparatus for producing a nonwoven fabric having the appearance of ribbed terry cloth, which comprises:

(a) liquid pervious forming means for supporting a layer of fibrous starting material whose individual fibers are in mechanical engagement with one another but which are capable of movement under applied liquid forces;

(b) means for projecting streams of high pressure, fine, essentially columnar jets of liquid; and (c) means for passing said layer of fibrous starting material directly under said streams while said layer is supported on said liquid pervious forming means, said liquid pervious forming means comprising a woven belt having a cross section through eight successive warps as shown in FIG. 10 herein.

12. Apparatus of claim 11, including vacuum means beneath said liquid pervious forming means, said vacuum means being positioned directly under said means for projecting streams of high pressure, fine, essentially columnar jets of liquid.

13. Apparatus of claim 11, wherein said woven belt contains 84 warps per inch and 32 picks per inch.

14. Apparatus of claim 11, wherein both the warps and the picks of the woven belt are about 0.157 inch in diameter.

* * * * *